US011583026B2

(12) United States Patent
Rietdyk

(10) Patent No.: US 11,583,026 B2
(45) Date of Patent: Feb. 21, 2023

(54) AUTOMATIC VISOR LOCKING SYSTEM

(71) Applicant: LIFT Airborne Technologies LLC, Rancho Dominguez, CA (US)

(72) Inventor: Guido Rietdyk, Rolling Hills, CA (US)

(73) Assignee: LIFT Airborne Technologies LLC, Rancho Dominguez, CA (US)

( * ) Notice: Subject to any disclaimer, the term of this patent is extended or adjusted under 35 U.S.C. 154(b) by 174 days.

(21) Appl. No.: 17/171,905

(22) Filed: Feb. 9, 2021

(65) Prior Publication Data

US 2022/0248796 A1 Aug. 11, 2022

(51) Int. Cl.
*A42B 3/22* (2006.01)

(52) U.S. Cl.
CPC ..... *A42B 3/223* (2013.01); *A42B 3/228* (2013.01)

(58) Field of Classification Search
CPC ..... A42B 3/223; A42B 3/228
See application file for complete search history.

(56) References Cited

U.S. PATENT DOCUMENTS 4,581,775 A * 4/1986 Nava ..... A42B 3/223 2/5
4,748,696 A * 6/1988 Fohl ..... A42B 3/223 2/10
4,907,300 A * 3/1990 Dampney ..... A42B 3/228 2/424
4,922,550 A * 5/1990 Verona ..... A42B 3/228 2/6.2
5,005,221 A * 4/1991 Chen ..... A42B 3/222 2/424
5,396,661 A 3/1995 Sutter et al.
5,412,814 A * 5/1995 Pernicka ..... A42B 3/221 2/424
5,813,048 A * 9/1998 Thom ..... A42B 3/221 2/424
5,987,651 A * 11/1999 Tanaka ..... A42B 3/223 2/424

(Continued)

FOREIGN PATENT DOCUMENTS

DE 102005016149 A1 10/2006
EP 0481860 A1 4/1992

(Continued)

OTHER PUBLICATIONS

Shoei Premium Helmets, GT-AIR II; https://www.shoei-helmets.com/gt-air-ii-features-summary, accessed Sep. 3, 2020; 16 pages.

*Primary Examiner* — Khaled Annis
(74) *Attorney, Agent, or Firm* — Lowe Graham Jones PLLC

(57) ABSTRACT

A helmet with a visor includes structures that engage to prevent inadvertent retraction of the visor. The visor may be pressed against a shoulder formed around the face opening of the helmet responsive to an inward force. Arms securing the visor the helmet may be include a slot permitting sliding to facilitate this movement. The arms may include an arcuate slot and a radial slot engaging a guide pin mounted to the helmet. With the visor down, the guide pin slides within the radial slot. A protrusion on the visor may be urged into a receptacle on the helmet in response to an inward force. A latch may engage the helmet when the visor is down and be releasable manually.

18 Claims, 9 Drawing Sheets

(56) References Cited

U.S. PATENT DOCUMENTS 6,047,409 A * 4/2000 Simpson ..... A42B 3/223 2/424
7,814,579 B2 10/2010 Dion
8,281,419 B2 * 10/2012 Rietdyk ..... A41D 13/0512 602/5
8,635,715 B2 1/2014 Hunt et al.
10,568,380 B2 2/2020 Salvetti et al.
11,278,078 B2 * 3/2022 Fiorino ..... A42B 3/222
2002/0189005 A1 * 12/2002 Taniuchi ..... A42B 3/223 2/424
2004/0019958 A1 * 2/2004 Arai ..... A42B 3/283 2/424
2004/0143888 A1 * 7/2004 Bataille ..... A42B 3/32 2/410
2006/0064799 A1 * 3/2006 Dion ..... A42B 3/326 2/424
2007/0074335 A1 * 4/2007 Gafforio ..... A42B 3/223 2/410
2007/0124851 A1 * 6/2007 Pyo ..... A42B 3/222 2/424
2009/0038057 A1 * 2/2009 Tews ..... A42B 3/223 2/427
2009/0288242 A1 * 11/2009 Kato ..... A42B 3/223 24/604
2010/0005558 A1 * 1/2010 Lee ..... A42B 3/223 2/15
2010/0107292 A1 * 5/2010 Chevallier ..... A42B 3/228 2/6.2
2012/0284906 A1 * 11/2012 Kuo ..... A42B 3/223 2/424
2012/0291185 A1 * 11/2012 Basson ..... A42B 3/042 2/424
2013/0212785 A1 * 8/2013 Ratti ..... A42B 3/04 16/221
2014/0352020 A1 * 12/2014 Isobe ..... A42B 3/223 2/9
2015/0264992 A1 * 9/2015 Happel ..... A42B 3/04 2/422
2015/0366284 A1 * 12/2015 Dowling ..... A42B 3/08 2/10
2017/0325534 A1 * 11/2017 Noordzij ..... A42B 3/222
2018/0027916 A1 * 2/2018 Smallwood ..... A42B 3/223
2018/0213877 A1 * 8/2018 Liao ..... A42B 3/225
2020/0037692 A1 2/2020 Levesque et al.
2020/0113268 A1 * 4/2020 Liao ..... A42B 3/223
2020/0146387 A1 * 5/2020 Nimura ..... A42B 3/326
2020/0163396 A1 * 5/2020 Kang ..... A42B 3/066
2020/0229529 A1 * 7/2020 Hunt ..... A42B 3/223
2020/0253316 A1 8/2020 Isobe
2020/0383417 A1 * 12/2020 Bohn ..... A42B 3/223
2021/0112904 A1 * 4/2021 Marziali ..... A42B 3/063
2021/0274877 A1 * 9/2021 Liao ..... A42B 3/326
2021/0307448 A1 * 10/2021 Sanders ..... A42B 3/225
2022/0071334 A1 * 3/2022 Huang ..... A42B 3/222

FOREIGN PATENT DOCUMENTS

EP 2531736 B1 3/2014
EP 2759219 B1 7/2014

* cited by examiner

AUTOMATIC VISOR LOCKING SYSTEM

FIELD OF THE INVENTION

This application relates to visors for helmets and, more particularly, to aviation helmets.

BACKGROUND OF THE INVENTION

Many helmets include a visor to protect the wearer's eyes from wind and debris. A visor may also be tinted to protect the wearer's eyes from sunlight. A visor may be retractable in order to enable the wearer to access the wearer's eyes or to obtain an untinted view. In aviation or other applications there may be sudden gusts of wind that may unintentionally retract the visor, such as if a pilot ejects from an airplane.

It would be an advancement in the art to improve the functioning of a helmet visor.

SUMMARY OF THE INVENTION

In one aspect of the invention, an apparatus includes a helmet configured to encase a head of a wearer and including a face opening for exposing at least a portion of a face of the wearer when the helmet is worn. The apparatus includes a visor assembly including a visor and a first arm secured to the visor. The first arm is movably secured the helmet such that the visor is positionable over the face opening when the visor assembly is in a down position and positionable above the face opening when the visor assembly is in a retracted position. The apparatus may include one or more structures fastened to one or more of the helmet and the visor assembly and configured to engage automatically when the visor assembly is in the down position to prevent movement of the visor assembly to the retracted position upon application of the inward and upward force on the visor assembly. The one or more structures may remain disengaged and not hinder movement of the visor assembly to the retracted position in the absence of the inward and upward force.

In some embodiments, the one or more structures include a shoulder extending inwardly from an outer surface of the helmet around the face opening. The shoulder may be positioned such that the inward and upward force urges an upper edge of the visor assembly against the shoulder.

In some embodiments, a shelf extends outwardly from the shoulder having the shoulder positioned between the shelf and the outer surface of the helmet. The shelf may be positioned to engage an inner surface of the visor responsive to the inward and upward force.

In some embodiments, the visor assembly includes one or more inwardly extending tabs configured to engage the helmet responsive to the inward and upward force when the visor assembly is in the down position.

In some embodiments, a second arm is secured to the visor. The first arm may be pivotally secured on a first side of the helmet and the second arm may be pivotally secured on a second side of the helmet. The face opening may be positioned between the first arm and the second arm. A first slot may be formed in the first arm and a second slot may be formed in the second arm. A first post may be secured to the helmet and pass through the first slot. A second post may be secured to the helmet and pass through the second slot. The first post may be slidable within the first slot and the second post may be slidable within the second slot. The first slot and the second slot may be configured to enable the visor to be pressed inwardly against the shoulder responsive to the inward and upward force.

In some embodiments, the apparatus includes a first arcuate slot formed in the first arm around the first slot and a second arcuate slot formed in the second arm around the second slot. The apparatus may include a first radial slot formed in the first arm and extending outwardly from the first arcuate slot and a second radial slot formed in the second arm and extending outwardly from the second arcuate slot. A first guide pin may be mounted to the helmet and be positioned in the first arcuate slot when the visor assembly is in the retracted position. The first guide pin may be positionable in the first radial slot when the visor assembly is in the down position responsive to the inward and upward force. A second guide pin may be mounted to the helmet and positioned in the second arcuate slot when the visor assembly is in the retracted position. The second guide pin may be positionable in the second radial slot when the visor assembly is in the down position responsive to the inward and upward force.

In some embodiments, the one or more structures include a protrusion extending rearwardly from the visor assembly and a receptacle mounted to the helmet. The receptacle may be positioned to receive the protrusion responsive to the inward and upward force. The protrusion may be sized and positioned not to engage the receptacle in the absence of the inward and upward force. The protrusion may be a tapered protrusion.

In some embodiments, the apparatus further includes a latch pivotally secured to the first arm and defining a first latching surface. The latch may include a biasing member urging the latch into engagement with a second latching surface mounted to the helmet when the visor assembly is in the down position. The engagement of the first latching surface with the second latching surface may hinder movement of the visor assembly to the retracted position. The biasing member and the second latching surface may be formed as a single member.

In some embodiments, a method includes subjecting the visor assembly in the down position to airflow causing an inward and upward force. The inward and upward force may cause movement of the visor assembly toward the face opening and cause the engagement structures to prevent pivoting of the visor into the retracted position.

The method may include, in the absence of airflow over the visor, pivoting the visor assembly between the down position and the retracted position without the one or more engagement structures hindering the pivoting.

In some embodiments, the method further includes responsive to the inward and upward force, urging an upper edge of the visor assembly against the shoulder thereby preventing the visor assembly from moving from the down position to the retracted position.

The method may include in absence of the inward and upward force, pivoting the visor assembly from the down position to the retracted position without the upper edge of the visor assembly engaging the shoulder.

In some embodiments, the method further includes sliding the first and second arms rearwardly relative to the first post and the second post responsive to the inward and upward force.

In some embodiments, the method further includes, while the visor assembly is in the down position, urging the second radial slot rearward over the first guide pin and urging the second radial slot rearward over the second guide pin responsive to the inward and upward force.

In some embodiments, the method further includes, with the visor assembly in the down position and responsive to the inward and upward force, urging the protrusion into the receptacle thereby preventing the visor assembly from moving to the retracted position.

In some embodiments, the method includes, with the latching assembly in the down position, pressing the latch and pivoting the latch such that the first latching surface moves out of engagement with the second latching surface.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

Figure 1:
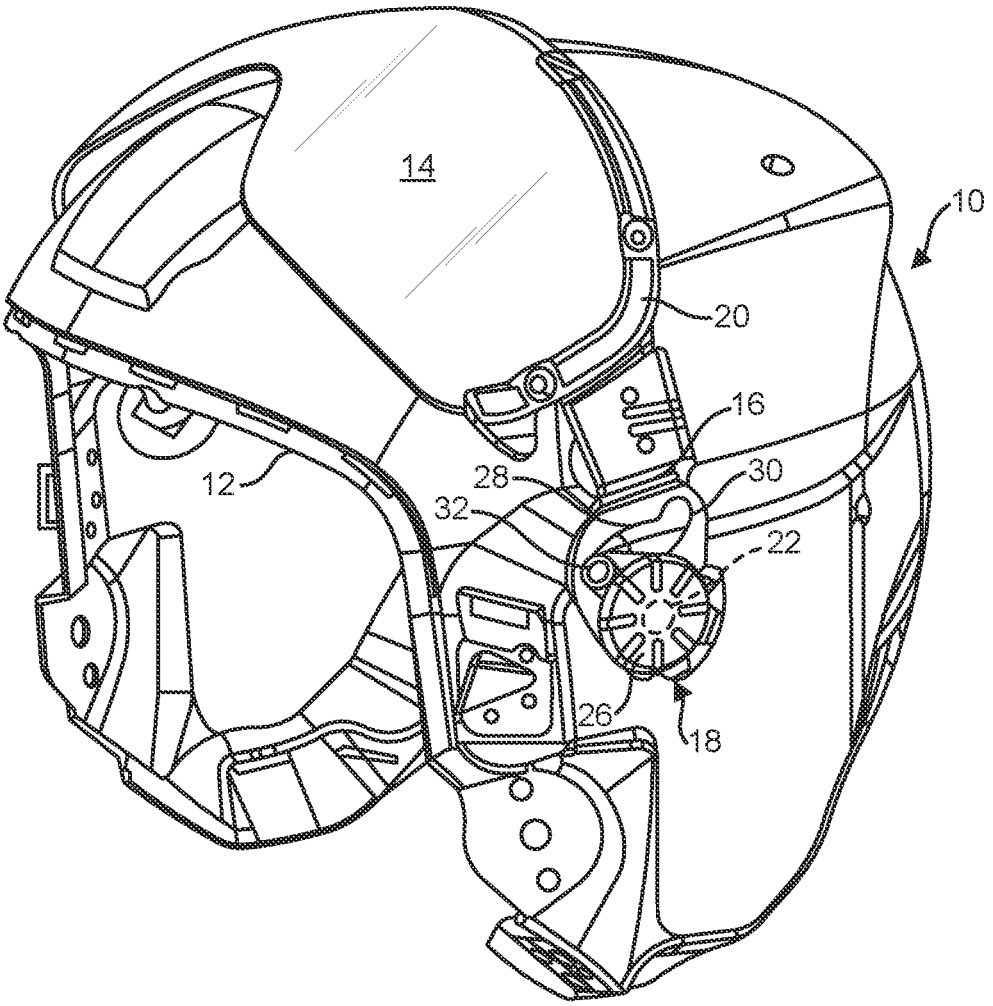
FIG. 1 is an isometric view of a helmet and visor in accordance with an embodiment of the present invention.

Referring to FIG. 1, a helmet 10, such as an aviation helmet or helmet for other applications, may define a face opening 12 through which a user's eyes and possibly nose are exposed through the helmet 10. A visor 14 is positionable over the face opening such that at least the eyes of the wearer are behind the visor 14. The visor 14 is transparent and may be tinted. The visor 14 may include a notch for the nose or oxygen mask of a wearer. The illustrated helmet 10 lacks a portion extending over the mouth and chin of the wearer. However, the visor locking system disclosed herein may be used in such helmets as well.

Retractability of the visor 14 may include arms 16 secured to either side of the visor 14 and extending to pivots 18 securing the arms 16 to the helmet 10 on either side of the face opening 12. Note that in the figures that only the right side of the helmet 10, visor 14, and other structures is shown in detail. Unless expressly indicated, the left side may be a mirrored configuration of the illustrated embodiments. The arms 16 may secure directly to the visor 14 or secure to a frame 20 extending completely or partially around the visor 14. For example, as shown, the frame 20 may extend around the top of the visor 14 and partially along the sides of the visor 14. The visor 14, arms 16, and frame 20 may be understood as being a visor assembly. The visor assembly may have a down position in which the visor 14 is positioned over and at least partially covering the opening 12 (see FIG. 4A) and a retracted position (FIG. 1) in which the visor 14 is positioned above and not covering the opening 12, the visor 14 in the retracted position being rotated higher and more rearward than the visor 14 in the down position.

When a pilot ejects from an airplane, the visor 14 is battered by high velocity air. A component of the velocity is typically directed inward, e.g., normal to the visor 14, urging the visor 14 into the opening 12. However, in many instances there is also an upward component that would tend to force the visor 14 into the retracted position. This can leave the pilot's eyes unprotected and subject to injury. Various structures are disclosed herein to prevent unintentional retraction of the visor 14.

Figure 2:
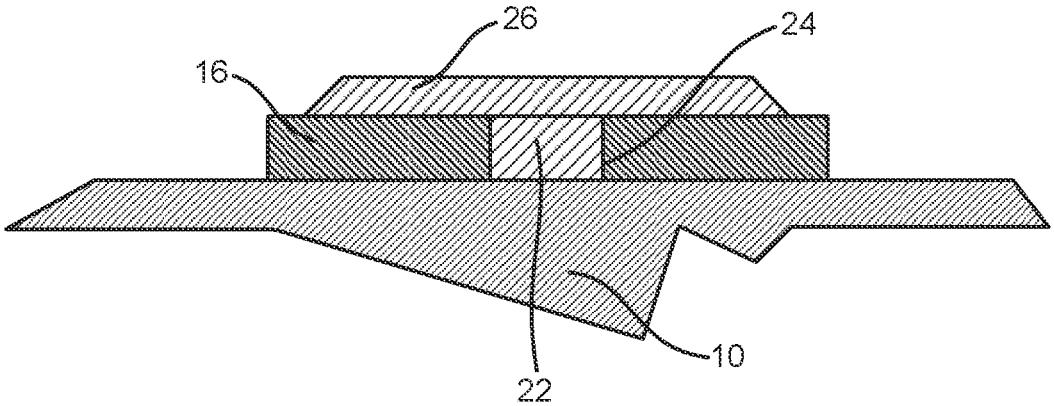
FIG. 2 is a side cross-sectional view of a visor pivot in accordance with an embodiment of the present invention.

Referring to FIG. 2, while still referring to FIG. 1, the pivot 18 securing each arm 16 to the helmet 10 may include a post 22 mounted to the helmet 10 that passes through an opening 24 in the arm 16. A cap 26 may secure to the post 22 and secure the arm 16 around the post 22 while still allowing the arm 16 to both rotate around the post 22 and slide relative to the post 22 as described below.

Each arm 16 may define an arcuate slot 28 having opposing sides that are substantially (e.g., within 2 mm of) concentric. A guide pin 32 that is fixed relative to the helmet 10 may insert within the slot 28 and be slidable within the slot 28. The guide pin 32 may be positioned such that when the guide pin 32 is positioned in the slot 28, the sides of the slot 28 are substantially (e.g., within 2 mm of) concentric with the a round part of the post 22 engaging the opening 24 in the arm 16.

Figure 3:
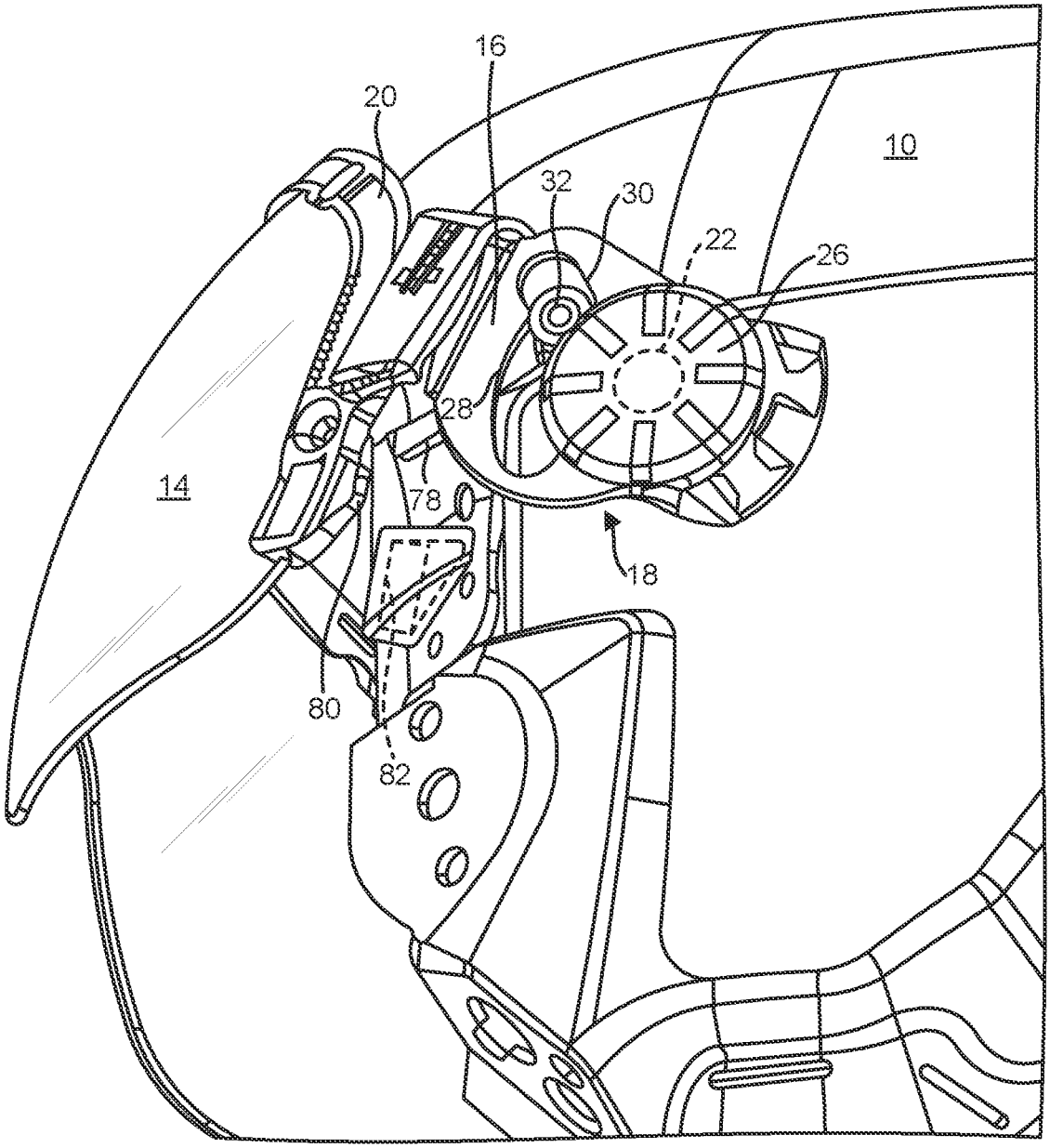
FIG. 3 is an isometric view of the helmet having the visor partially retracted in accordance with an embodiment of the present invention.

Referring to FIG. 3, when the visor 14 is down and over the opening 12 and in the absence of a force pressing the visor 14 against the perimeter of the opening 12, the guide pin 32 may be positioned at a junction of the slot 28 and the slot 30.

Figure 4A:
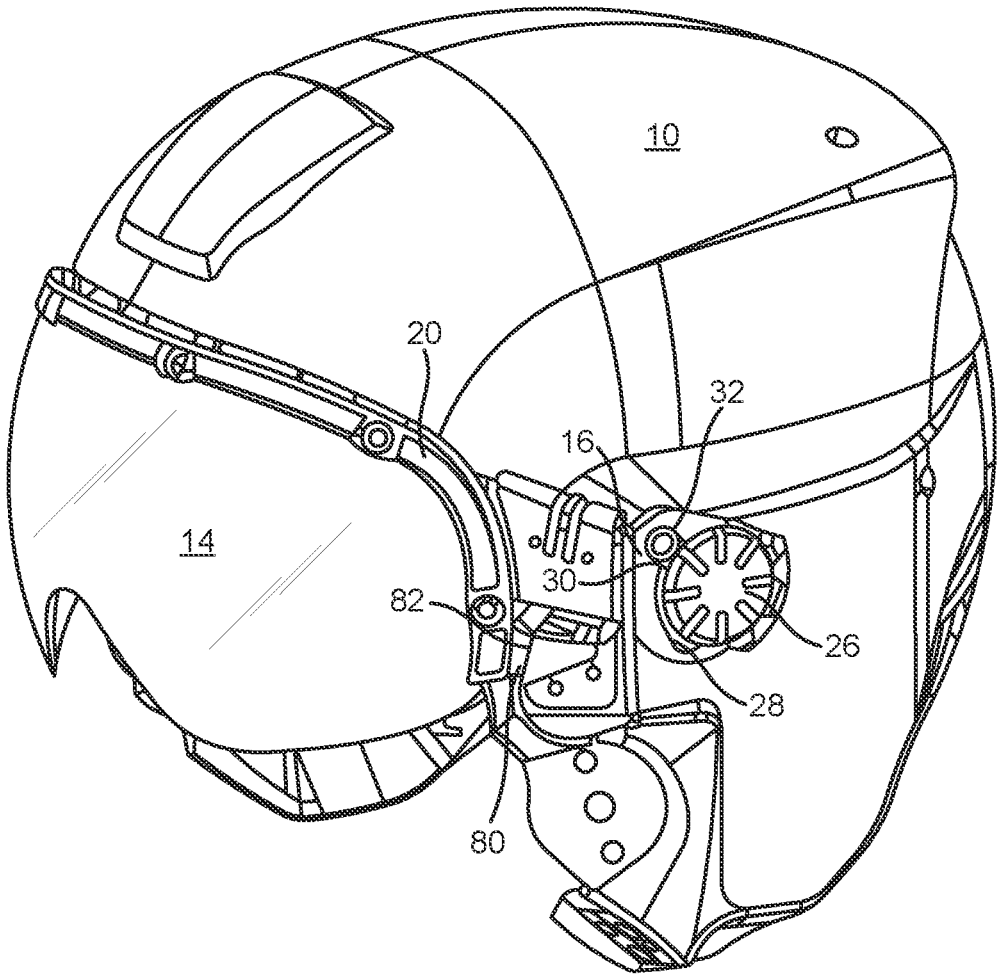
FIGS. 4A and 4B are isometric views of the helmet having the visor down and compressed in accordance with an embodiment of the present invention.
Figure 4B:
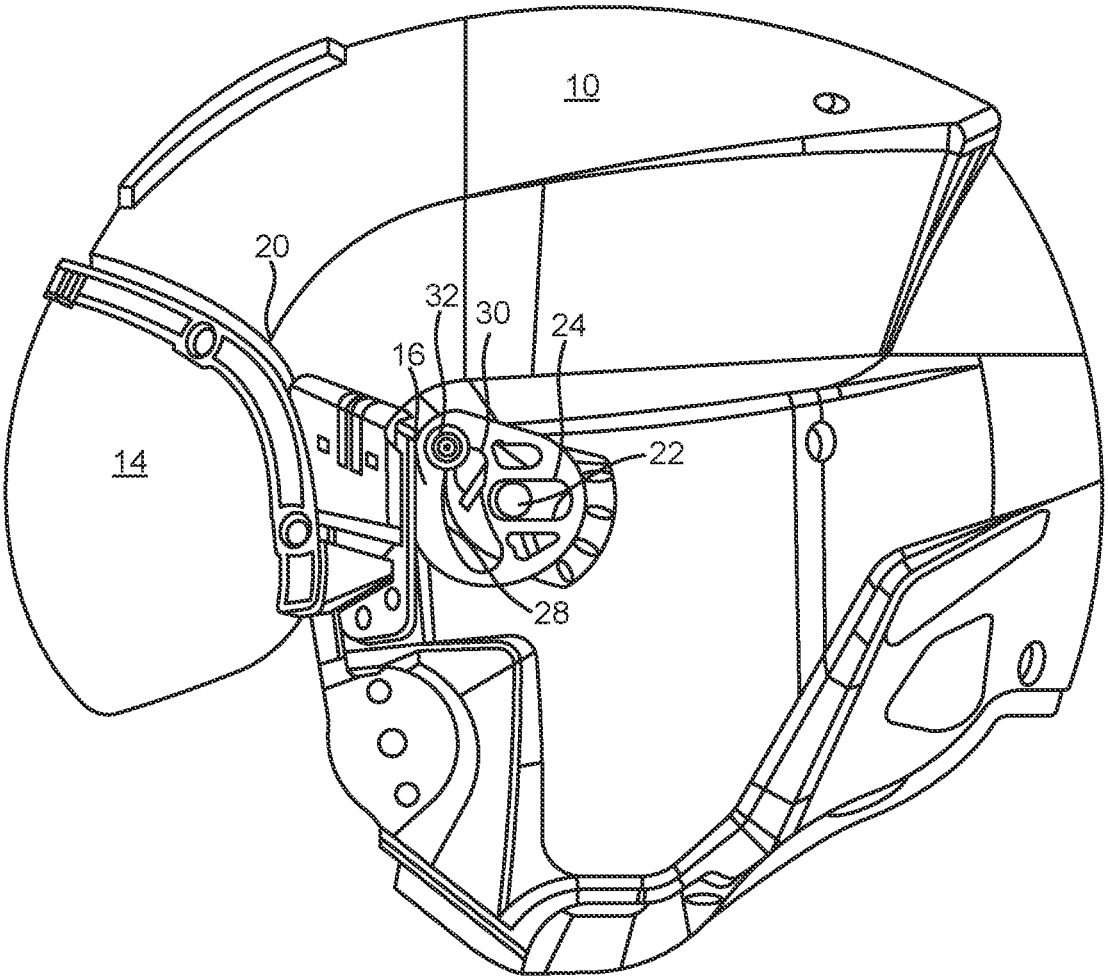

Referring to FIG. 4A, a force exerted on the visor 14 presses the visor against the perimeter of the opening 12 such that the arms 16 may be urged rearwardly relative to the guide pin 32. Under such force the guide pin 32 slides into the slot 30. As is apparent in FIG. 4B, the opening 24 may be an elongate slot 24 (e.g., a discorectangle rather than circular) such that the arm 16 may slide relative to the post 22. Note further that in the illustrated implementation, the sides of the slot 24 are not parallel to the sides of the slot 30. This non-parallel arrangement may guide the arms 16 to rotate and move the visor 14 along an inward and slightly downward path responsive to the inward and upward force. In other embodiments, straight portions of the slot 24 and slot 30 are parallel to one another. In either case, the presence of the guide pin 32 in the slot 30 may function to resist rotation of the visor 14 and therefore unintentional retraction is hindered.

Figure 5:
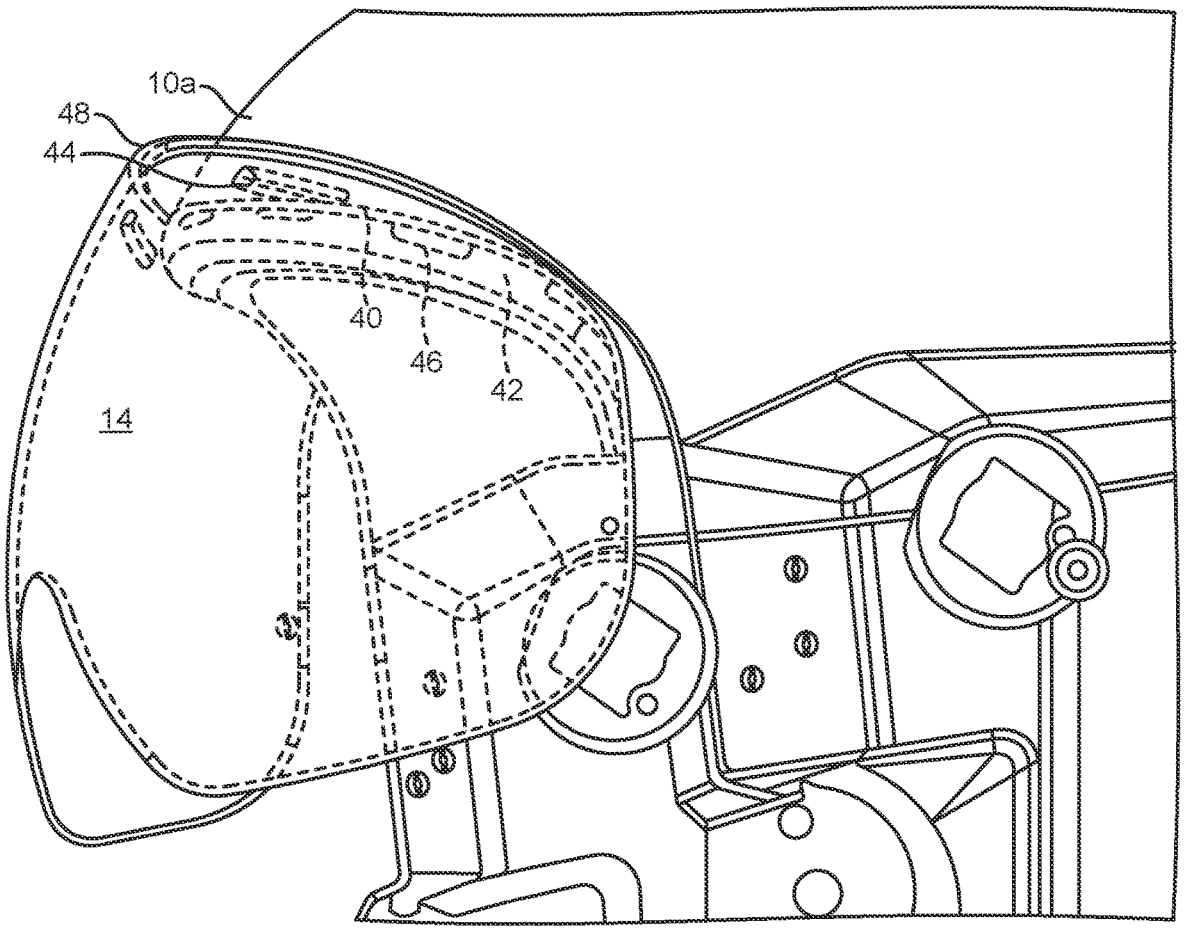
FIG. 5 is an isometric view of a helmet and visor showing features for preventing unintentional retraction in accordance with an embodiment of the present invention.
Figure 6:
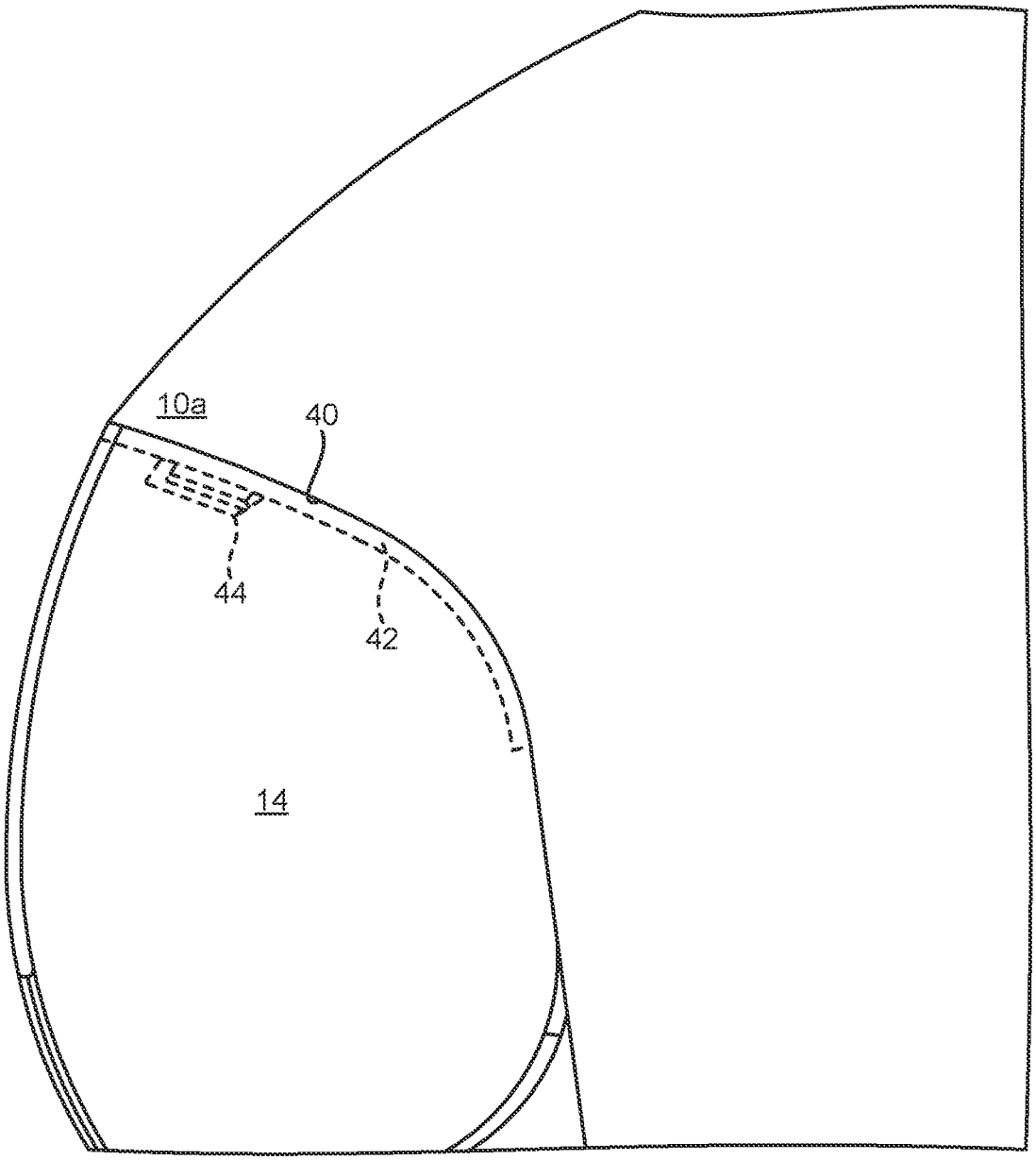
FIG. 6 is a side-elevational view of the helmet and visor with the features for preventing unintentional retraction engaged in accordance with an embodiment of the present invention.
Figure 7:
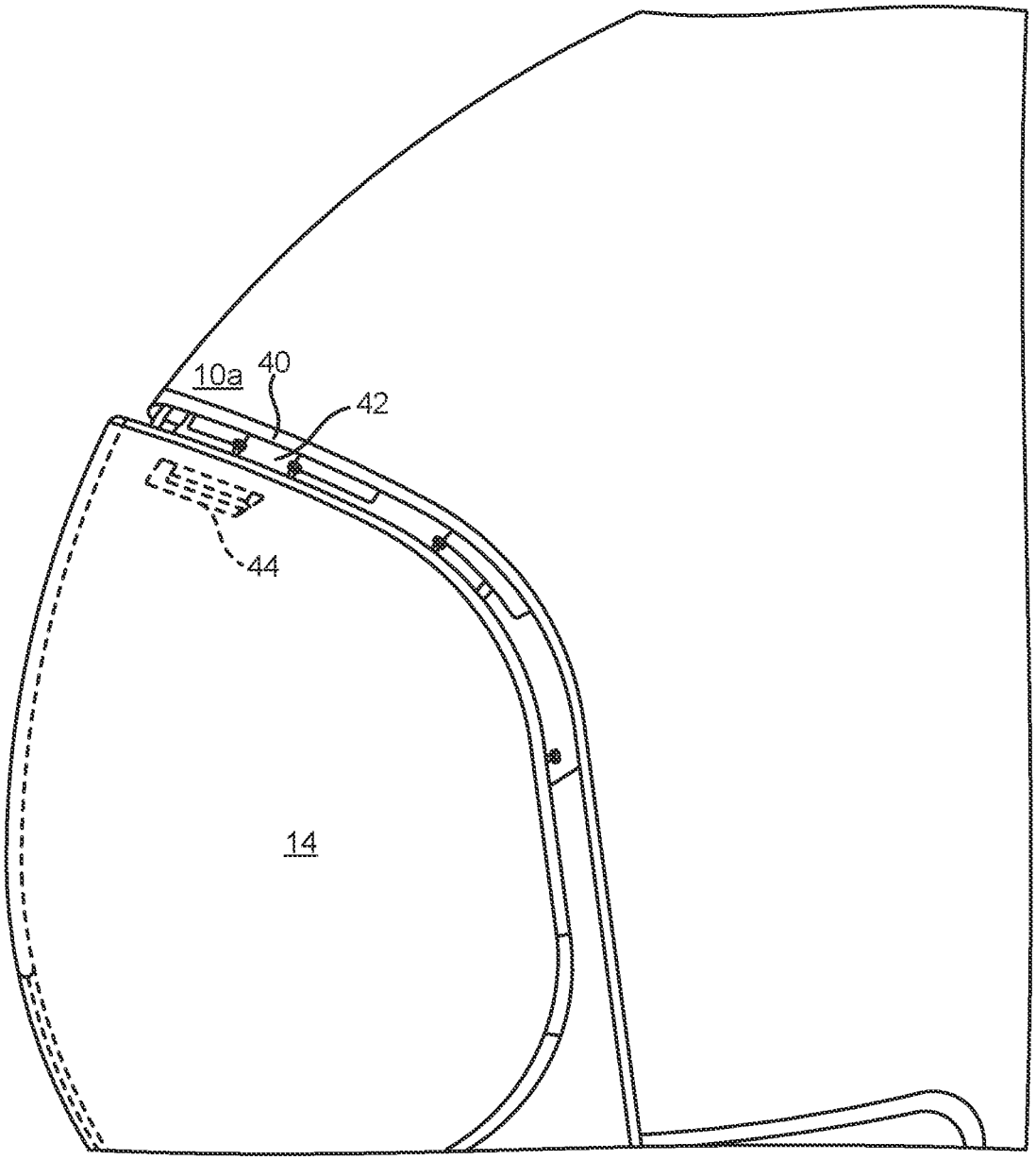
FIG. 7 is a side-elevational view of the helmet and visor with the features for preventing unintentional retraction engaged in accordance with an embodiment of the present invention.

Referring to FIGS. 5, 6, and 7, the visor 14 and opening 12 may be configured such that the movement of the visor 14 and arms 16 relative to the post 22 tends to automatically lock the visor 14 and prevent it from unintentionally retracting in response to air pressure acting on the visor 14.

Referring specifically to FIG. 5, the helmet 10 may include a shoulder 40 extending inwardly at least partially around the opening 12. For example, at least an upper edge of the helmet 10 may include a shoulder 40. A shelf 42 may extend outwardly from the shoulder 40 such that the shelf is recessed inwardly from an outer surface 10*a* of the helmet around opening 12. Stated differently, opening 12 may be defined by the shoulder 40 such that locally (e.g., any 2 mm segment) along the length of the shoulder 40 the shoulder is generally (e.g., within 10 degrees of) perpendicular to the outer surface 10*a* of the helmet 10. The shelf 42 may extend outwardly from the shoulder 40 such that locally along its length, the shelf is generally perpendicular to the shoulder 40. The visor 14 may further define one or more locking tabs 44 spaced inwardly from the rim 48 and defining surfaces that are locally generally perpendicular to the inner surface of the visor 14 and generally parallel to the upper edge (rim 48) of visor 14 at their points of attachment to the visor 14.

Referring to FIG. 6, responsive to an inward force on the visor 14, the tabs 44 may be urged into recesses 46 defined by the shelf 42. Alternatively, the tabs 44 may engage an edge of the shelf 42 and a rim 48 of the visor 14 may be pressed against the shoulder 40 at one or more points. In some embodiments, the tabs 44 are omitted and engagement with the rim 48 and shoulder 40 is used to provide locking.

Referring to FIG. 7, in the absence of an inward force on the visor 14, the rim 48 and/or tabs 44 are not engaged. Likewise, the guide pin 32 (see FIG. 3) is not urged into slot 30 and rotation about the post 22 may be performed with the guide pin 32 moving through the arcuate slot 28.

Figure 8:
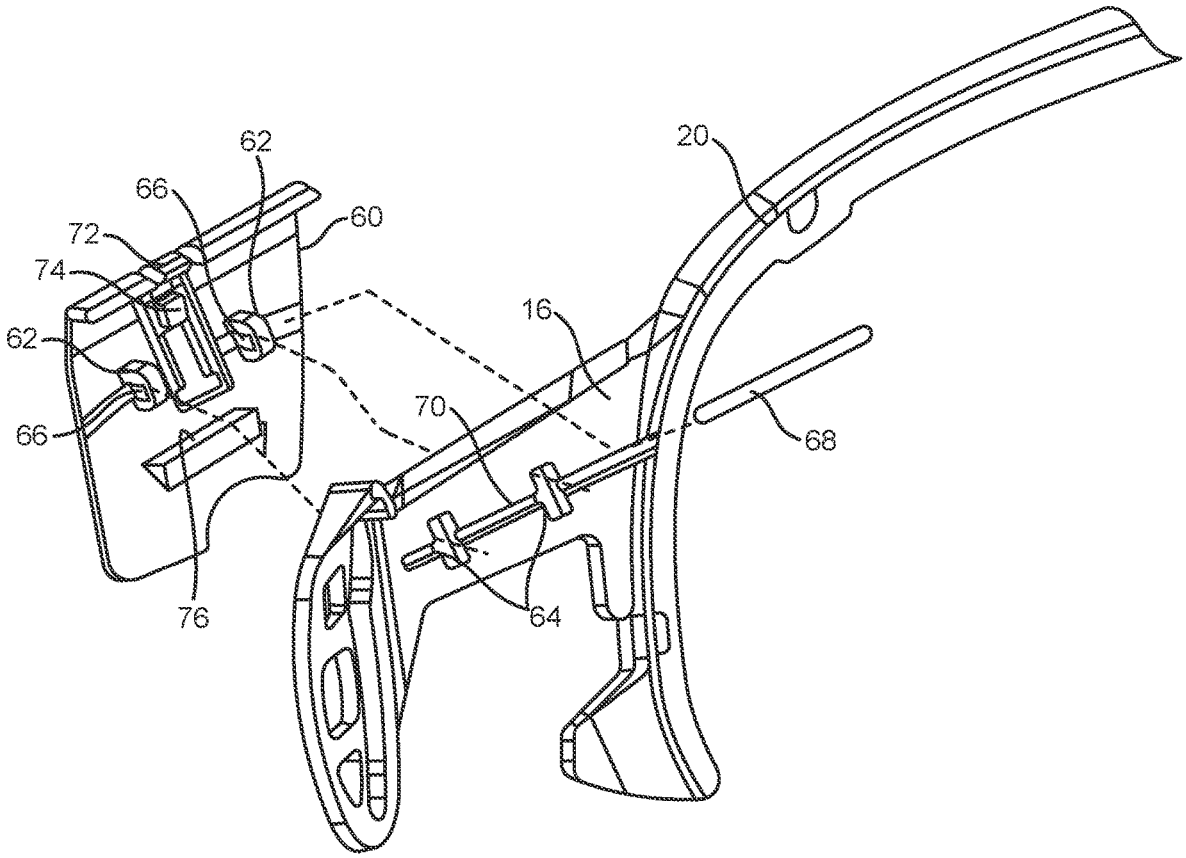
FIG. 8 is an exploded view of a visor latch in accordance with an embodiment of the present invention.

Referring to FIG. 8, unintentional retraction of the visor 14 may additionally or alternatively be resisted with the illustrated latching system. A lever 60 may pivotally secure to one of the arms 16 of the visor 14. It is expected that one handed operation will be desirable. Accordingly, levers 60 are not provided on both arms 16 in the illustrated embodiment. However, levers 60 may be provide on both arms 16 in some applications.

In the illustrated embodiment, pivotal securement may be provided by two pivot tabs 62 protruding outwardly from the lever 60. The tabs 62 may pass through openings 64 in the arm 16 such that openings 66 in the tabs 62 are positioned on an opposite side of the arm 16 from the lever 60. A pin 68 may be inserted through the openings 66 to retain the lever 60. The arm 16 may define a groove 70 into which the pin 68 seats.

A biasing member 72 may urge a first portion of the lever 60 away from the arm 16. In the illustrated embodiment, the biasing member is formed by a portion of the lever 60 that is cut away and having a protrusion 74 formed thereon and extending inwardly toward the arm 16. Accordingly, the first portion of the lever 60 may be urged toward the arm 16, thereby engaging the protrusion 74 with the arm 16 and deflecting the biasing member 72. The biasing member 72 will thereafter exert a biasing force urging the first portion the lever 60 urging the first portion away from the arm 16.

A second portion of the lever 60 on an opposite side of the pin 68 from the biasing member 72 may have a latching surface 76 formed thereon on a surface facing the arm 16 and the helmet 10. Accordingly, the biasing force of the biasing member 72 will urge the latching surface 76 toward the arm 16 and the helmet 10.

Referring again to FIG. 3, a corresponding latching surface 78 may be defined on the helmet 10. For example, surface 78 may face downwardly whereas surface 76 faces upwardly during use. When the visor 14 is down, the latching surface 76 engages the latching surface 78 thereby resisting retraction of the visor 14. A wearer may then press the upper portion of the lever 60 to rotate the lever 60 about the pin 68 and urge the latching surface 76 away from the latching surface 78 thereby facilitating retraction of the visor 14.

FIG. 3 further illustrates additional features that may be used to hinder unintentional retraction of the visor 14. The visor 14, such as a portion of the frame 20 of the visor may define a protrusion 80. The protrusion 80 may be tapered with distance from the visor 14. A receptable 82 may be defined by the helmet 10, e.g., a structure secured to the helmet 10. The receptable 82 may likewise be tapered such that the receptacle 82 narrows with distance from an opening of the receptacle 82. As is apparent in FIG. 3, the receptacle 82 opens forwardly such that rearward motion of the protrusion 80 due to an inward force on the visor 14 urges the protrusion 80 into the receptacle 82. For example, FIG. 4A shows a portion of the protrusion 80 inserted within the receptacle 82.

As is apparent in the above description, resistance of unintentional retraction of the visor 14 may be provided by all of (a) the slot 30 engaging the guide pin 32, (b) the rim 48 and/or tabs 44, and (c) the protrusion 80 engaging the receptacle 82. All, any two of, or any one of (a), (b), and (c) may be used alone to resist unintentional retraction of the visor 14. For example, rather than use of a elongate opening 24 and radial slot 30, the opening 24 may be circular. Deflection of the visor 14 itself in response to an inward force may be sufficient to engage the shoulder 40, shelf 42, and/or recesses 46 sufficient to prevent unintentional retraction of the visor 14.

While the preferred embodiments of the invention have been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. An apparatus comprising:

a helmet configured to encase a head of a wearer and including a face opening for exposing at least a portion of a face of the wearer when the helmet is worn;

a visor assembly including a visor, a first arm secured to the visor, the first arm being movably secured to the helmet such that the visor is positionable over the face opening when the visor assembly is in a down position and positionable above the face opening when the visor assembly is in a retracted position; and one or more structures fastened to one or more of the helmet and the visor assembly and configured to engage automatically when the visor assembly is in the down position to prevent movement of the visor assembly to the retracted position upon application of an inward and upward force on the visor assembly and to remain disengaged and not hinder movement of the visor assembly to the retracted position in the absence of the inward and upward force;

wherein the one or more structures include a shoulder extending inwardly from an outer surface of the helmet around the face opening and positioned such that the inward and upward force urges an upper edge of the visor assembly against the shoulder.

2. The apparatus of claim 1, further comprising a shelf extending outwardly from the shoulder having the shoulder positioned between the shelf and the outer surface of the helmet, the shelf being positioned to engage an inner surface of the visor responsive to the inward and upward force.

3. The apparatus of claim 1, wherein the visor assembly includes one or more inwardly extending tabs configured to engage the helmet responsive to the inward and upward force when the visor assembly is in the down position.

4. The apparatus of claim 1, further comprising:

a second arm secured to the visor, the first arm being pivotally secured on a first side of the helmet and the second arm being pivotally secured on a second side of the helmet, the face opening being positioned between the first arm and the second arm;

a first elongate slot formed in the first arm;

a second elongate slot formed in the second arm;

a first post secured to the helmet and passing through the first elongate slot, the first post slidable within the first elongate slot; and a second post secured to the helmet and passing through the second elongate slot, the second post slidable within the second elongate slot;

wherein the first elongate slot and the second elongate slot are configured to enable the visor to be pressed inwardly against the shoulder responsive to the inward and upward force.

5. The apparatus of claim 4, further comprising:

a first arcuate slot formed in the first arm around the first elongate slot;

a first radial slot formed in the first arm and extending outwardly from the first arcuate slot;

a second arcuate slot formed in the second arm around the second elongate slot;

a second radial slot formed in the second arm and extending outwardly from the second arcuate slot;

a first guide pin mounted to the helmet and positioned in the first arcuate slot when the visor assembly is in the retracted position and positionable in the first radial slot when the visor assembly is in the down position responsive to the inward and upward force; and a second guide pin mounted to the helmet and positioned in the second arcuate slot when the visor assembly is in the retracted position and positionable in the second radial slot when the visor assembly is in the down position responsive to the inward and upward force.

6. An apparatus comprising:

a helmet configured to encase a head of a wearer and including a face opening for exposing at least a portion of a face of the wearer when the helmet is worn;

a visor assembly including a visor, a first arm secured to the visor, the first arm being movably secured the helmet such that the visor is positionable over the face opening when the visor assembly is in a down position and positionable above the face opening when the visor assembly is in a retracted position; and one or more structures fastened to one or more of the helmet and the visor assembly and configured to engage automatically when the visor assembly is in the down position to prevent movement of the visor assembly to the retracted position upon application of an inward and upward force on the visor assembly and to remain disengaged and not hinder movement of the visor assembly to the retracted position in the absence of the inward and upward force;

wherein the one or more structures include a protrusion extending rearwardly from the visor assembly and a receptacle mounted to the helmet and positioned to receive the protrusion responsive to the inward and upward force, the protrusion sized and positioned not to engage the receptacle in the absence of the inward and upward force.

7. The apparatus of claim 6, wherein the protrusion is a tapered protrusion.

8. An apparatus comprising:

a helmet configured to encase a head of a wearer and including a face opening for exposing at least a portion of a face of the wearer when the helmet is worn;

a visor assembly including a visor, a first arm secured to the visor, the first arm being movably secured the helmet such that the visor is positionable over the face opening when the visor assembly is in a down position and positionable above the face opening when the visor assembly is in a retracted position;

one or more structures fastened to one or more of the helmet and the visor assembly and configured to engage automatically when the visor assembly is in the down position to prevent movement of the visor assembly to the retracted position upon application of an inward and upward force on the visor assembly and to remain disengaged and not hinder movement of the visor assembly to the retracted position in the absence of the inward and upward force; and a latch pivotally secured to the first arm and defining a first latching surface, the latch including a biasing member urging the latch into engagement with a second latching surface mounted to the helmet when the visor assembly is in the down position, the engagement of the first latching surface with the second latching surface hindering movement of the visor assembly to the retracted position.

9. The apparatus of claim 8, wherein the biasing member and second latching surface are formed as a single member.

10. A method comprising:

providing a helmet configured to encase a head of a wearer and including an opening for exposing the eyes of the wearer when the helmet is worn;

providing a visor assembly pivotally secured to the helmet and having a down position in which a visor of the visor assembly is positioned over the opening and a retracted position in which the visor is above the opening;

providing one or more engagement structures fastened to one or more of the helmet and the visor assembly; and subjecting the visor assembly in the down position to airflow causing an inward and upward force causing movement of the visor assembly toward the opening and causing the one or more engagement structures to prevent pivoting of the visor into the retracted position;

wherein the one or more engagement structures include a shoulder extending inwardly from an outer surface of the helmet around the opening, the method further comprising:

responsive to the inward and upward force, urging an upper edge of the visor assembly against the shoulder thereby preventing the visor assembly from moving from the down position to the retracted position.

11. The method of claim 10, further comprising, in the absence of airflow over the visor, pivoting the visor assembly between the down position and the retracted position without the one or more engagement structures hindering the pivoting.

12. The method of claim 10, further comprising:

in absence of the inward and upward force, pivoting the visor assembly from the down position to the retracted position without the upper edge of the visor assembly engaging the shoulder.

13. The method of claim 10, wherein:

the visor assembly further comprises:

a first arm secured to the visor, and a second arm secured to the visor, the first arm pivotally secured on a first side of the helmet and a second arm pivotally secured on a second side of the helmet opposite the first side;

a first elongate slot formed in the first arm;

a second elongate slot formed in the second arm;

a first post secured to the helmet and passing through the first elongate slot, the first post slidable within the first elongate slot; and a second post secured to the helmet and passing through the second elongate slot, the second post slidable within the second elongate slot; and the method further comprises sliding the first and second arms rearwardly relative to the first post and the second post responsive to the inward and upward force.

14. The method of claim 13, wherein:

the visor assembly further comprises:

a first arcuate slot formed in the first arm around the first elongate slot;

a first radial slot formed in the first arm and extending outwardly from the first arcuate slot;

a second arcuate slot formed in the second arm around the second elongate slot;

a second radial slot formed in the second arm and extending outwardly from the second arcuate slot;

a first guide pin mounted to the helmet and positioned in the first arcuate slot when the visor assembly is in the retracted position; and a second guide pin mounted to the helmet and positioned in the second arcuate slot when the visor assembly is in the retracted position; and the method further comprises, while the visor assembly is in the down position, urging the second radial slot rearward over the first guide pin and urging the second radial slot rearward over the second guide pin responsive to the inward and upward force.

15. A method comprising:

providing a helmet configured to encase a head of a wearer and including an opening for exposing the eyes of the wearer when the helmet is worn;

providing a visor assembly pivotally secured to the helmet and having a down position in which a visor of the visor assembly is positioned over the opening and a retracted position in which the visor is above the opening;

providing one or more engagement structures fastened to one or more of the helmet and the visor assembly; and subjecting the visor assembly in the down position to airflow causing an inward and upward force causing movement of the visor assembly toward the opening and causing the one or more engagement structures to prevent pivoting of the visor into the retracted position;

wherein:

the one or more engagement structures include a protrusion extending rearwardly from the visor assembly and a receptacle mounted to the helmet and positioned to receive the protrusion responsive to the inward and upward force, the protrusion sized and positioned not to engage the receptacle in the absence of the inward and upward force; and the method further comprises, with the visor assembly in the down position and responsive to the inward and upward force, urging the protrusion into the receptacle thereby preventing the visor assembly from moving to the retracted position.

16. The method of claim 15, wherein the protrusion is a tapered protrusion.

17. A method comprising:

providing a helmet configured to encase a head of a wearer and including an opening for exposing the eyes of the wearer when the helmet is worn;

providing a visor assembly pivotally secured to the helmet and having a down position in which a visor of the visor assembly is positioned over the opening and a retracted position in which the visor is above the opening;

providing one or more engagement structures fastened to one or more of the helmet and the visor assembly;

subjecting the visor assembly in the down position to airflow causing an inward and upward force causing movement of the visor assembly toward the opening and causing the one or more engagement structures to prevent pivoting of the visor into the retracted position;

providing a first arm secured to the visor, and a second arm secured to the visor, the first arm pivotally secured on a first side of the helmet and a second arm pivotally secured on a second side of the helmet opposite the first side providing a latch pivotally secured to the first arm and defining a first latching surface, the latch including a biasing member urging the latch into engagement with a second latching surface mounted to the helmet when the visor assembly is in the down position, the engagement of the first latching surface with the second latching surface hindering movement of the visor assembly to the retracted position;

with the visor in the down position, pressing the latch and pivoting the latch such that the first latching surface moves out of engagement with the second latching surface; and rotating the visor to the retracted position.

18. The method of claim 17, wherein the biasing member and second latching surface are formed as a single member.

* * * * *